US005754926A

United States Patent [19]

Sakuraba et al.

[11] Patent Number: 5,754,926

[45] Date of Patent: May 19, 1998

[54] CHARGING DEVICE

[75] Inventors: Tamotsu Sakuraba; Hirofumi Hasegawa; Tetsumaru Fujita, all of Toyokawa, Japan

[73] Assignee: Minolta Co., Ltd., Osaka, Japan

[21] Appl. No.: 610,868

[22] Filed: Mar. 5, 1996

[30] Foreign Application Priority Data

| | | | |
|---|---|---|---|
| Mar. 6, 1995 | [JP] | Japan | 7-045383 |
| Jun. 6, 1995 | [JP] | Japan | 7-139400 |
| Jan. 23, 1996 | [JP] | Japan | 8-009069 |

[51] Int. Cl.[6] ..... G03G 15/02

[52] U.S. Cl. ..... 399/175; 399/174; 361/225

[58] Field of Search ..... 355/219, 269, 355/270; 361/214, 225, 230; 399/174, 175

[56] References Cited

U.S. PATENT DOCUMENTS

| | | | |
|---|---|---|---|
| 4,123,154 | 10/1978 | Fisher | 361/225 X |
| 4,457,615 | 7/1984 | Seanor | 118/652 X |
| 5,148,219 | 9/1992 | Kohyama | 355/219 |
| 5,196,892 | 3/1993 | Mitsuaki | 355/269 |
| 5,221,946 | 6/1993 | Kohyama | 355/270 |
| 5,455,661 | 10/1995 | Yoshida et al. | 355/219 |
| 5,541,717 | 7/1996 | Saito et al. | 355/269 |
| 5,557,372 | 9/1996 | Ojima et al. | 399/174 |
| 5,592,264 | 1/1997 | Shigeta et al. | 399/175 |

FOREIGN PATENT DOCUMENTS

| | | | |
|---|---|---|---|
| 61-42669 | 3/1986 | Japan | 355/219 |
| 2-064668 | 3/1990 | Japan . | |
| 2-135487 | 5/1990 | Japan . | |
| 3-181984 | 8/1991 | Japan . | |
| 4-142566 | 5/1992 | Japan | 355/219 |
| 4-366863 | 12/1992 | Japan | 355/219 |
| 5-346726 | 12/1993 | Japan | 355/270 |
| 5-346751 | 12/1993 | Japan | 355/270 |
| 6-186820 | 7/1994 | Japan . | |
| 6-186892 | 7/1994 | Japan . | |
| 7-281508 | 10/1995 | Japan . | |

*Primary Examiner*—Matthew S. Smith
*Attorney, Agent, or Firm*—Sidley & Austin

[57] ABSTRACT

In a charging device used in a cleanerless image forming apparatus and including a charging brush in contact with an image bearing member, a scraping member is provided which is in contact with the charging brush with a predetermined amount of indentation overlap on an upstream side of a contact portion between the charging brush and the image bearing member with respect to a rotational direction of the charging brush. With such an arrangement, the developer, which is scraped from the charging brush by the scraping member and then adheres onto the image bearing member, is recharged by the charging brush so as to be collected by a developing-cleaning device.

19 Claims, 8 Drawing Sheets

CHARGING DEVICE

BACKGROUND OF THE INVENTION

1. Field of the Invention

The present invention pertains to a charging device used in an electrophotographic image forming apparatus, such as a copier or printer, and more particularly, to a charging device used in a cleanerless image forming apparatus.

2. Description of the Related Art

In the area of electrophotographic image forming apparatus, a cleanerless image forming apparatus is conventionally well-known which is equipped with a developing-cleaning means in which an electrostatic latent image is formed through the exposure of an image carrier charged by a charging brush in contact with said image carrier with rotation, and in which the electrostatic latent image is developed into an image by developer and at the same time the developer that was not transferred to a transfer medium at a previous image transfer and remains on the image carrier is collected by said developing-cleaning means.

In an image forming apparatus of this type, the developer remaining on the image carrier surface after the developer image is transferred to the transfer medium is removed not by using a dedicated cleaner but by utilizing a difference between a potential of a developing bias voltage that is applied to the developing-cleaning means and a surface potential of the image carrier. Specifically, to the image area on the surface of the image carrier with a reduced potential due to the exposure after uniform charge of the image carrier by the charging brush, developer is electrostatically attracted from the developing-cleaning means to which a developing bias voltage is applied, and developing is achieved in the same way as in regular reversal developing. On the other hand, developer that remains on the image carrier after the previous transfer and is located in non-image areas that have not been exposed, is electrostatically attracted to the developing-cleaning means based on the difference in potential between the surface of the uniformly charged image carrier and the developing bias voltage, and thereby collected.

In an image forming apparatus applying the reversal developing method, developer which is charged with the original charging polarity, in other words, the same polarity as the image carrier, and at the same time, remains on the image carrier after image transfer, is removed in the manner described above. However, the developer that remains after image transfer contains, besides the developer charged with the original charging polarity, developer charged with the opposite polarity due to the influence of the transferring means, etc. Such developer having the opposite polarity is electrostatically attracted to the charging brush, and the developer that is charged with the original polarity is also mechanically swept by the charging brush together with said developer having the opposite polarity and sticks to the brush. As a result, if a large volume of printing is performed with a cleanerless image forming apparatus, the developer gradually accumulates on the charging brush, causing the following problems.

When the developer that sticks to the charging brush has accumulated, the developer may be splashed from the brush onto the image carrier due to the shock force generated when the brush, which is bent by contacting with the image carrier, recovers its original shape due to its elasticity, as well as due to the centrifugal force arising from the rotation of the brush. In such a case, developer having different polarities coagulates into lumps on the image carrier, and these lumps hinder exposure, causing unevenness in exposure and therefore a reduction in image quality. This tendency is marked in full color images. In particular, a sandy appearance is present in the halftone areas of a full color image, and image quality remarkably deteriorates.

In addition, the more developer, which sticks to the brush, the weaker becomes the action to charge the image carrier surface and the residual developer that exists on said surface as well as the action to attract said developer having the opposite polarity. Therefore, residual developer having the opposite polarity or insufficient charge easily passes through the charging brush and is not collected by the developer cleaning device. Instead, it reaches the transfer area as the image carrier rotates and is transferred onto the transfer medium, causing a background fog.

In order to resolve the above problems, U.S. Pat. Nos. 5,148,219 and 5,221,946 disclose an image forming apparatus in which a voltage of +100v to +300v is applied to the charging brush so that it has the same polarity as the developer having the opposite polarity (+) (−700v through −1500v for regular image forming) while the image forming apparatus is not forming an image, or namely, during the non-image forming cycle where no image is being developed or transferred, such that the developer sticking to the charging brush is forced to be released onto the image carrier and is collected by a developing-cleaning means.

Nevertheless, in the image forming apparatus described above, the developer released from the charging brush includes some developer that is charged with the proper charging polarity (−) and other developer that is charged with the opposite polarity (+). Therefore, the developer having the same polarity as the charging polarity (−) is collected by the developing-cleaning means, but the developer having a polarity opposite to that of the image carrier (+) is not collected. The developer that is not collected ends up being transferred onto the transfer medium, or sticks again to the charging brush that has returned to the voltage state for regular image forming and accumulates there, and as a result, problems including insufficient charging, background fog and sandy halftones cannot be prevented.

Where the developer collected by the charging brush has entered the inside of the brush, developer particles having different polarities coagulate via electrostatic attachment and stick to the brush. Consequently, the developer sticking to the brush cannot be released by electrostatic repulsion even if the charging polarity of the charging brush is switched.

SUMMARY OF THE INVENTION

The main object of the present invention is to provide a charging device for a cleanerless image forming apparatus, which is capable of ensuring the prevention of accumulation of developer on the charging brush.

Another object of the present invention is to provide a charging device for a cleanerless image forming apparatus wherein stable images can be obtained without a reduction in image quality even if a large volume of printing is performed.

These and other objects of the present invention are accomplished by a charging device in an image forming apparatus which includes a developing-cleaning device for developing an electrostatic latent image on an image bearing member and at the same time, for collecting residual developer remaining on the image bearing member after a previous transfer. The charging device comprises a charging brush in contact with the image bearing member for charging the surface of the image bearing member, and a scraping member contacting with the charging brush with a predetermined amount of indentation overlap at an upstream side of a contact portion between the charging brush and the image bearing member with respect to a rotational direction of the charging brush.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DETAILED DESCRIPTION OF THE PREFERRED EMBODIMENTS

Embodiments of the present invention are explained below with reference to the accompanying drawings.

Figure 1:
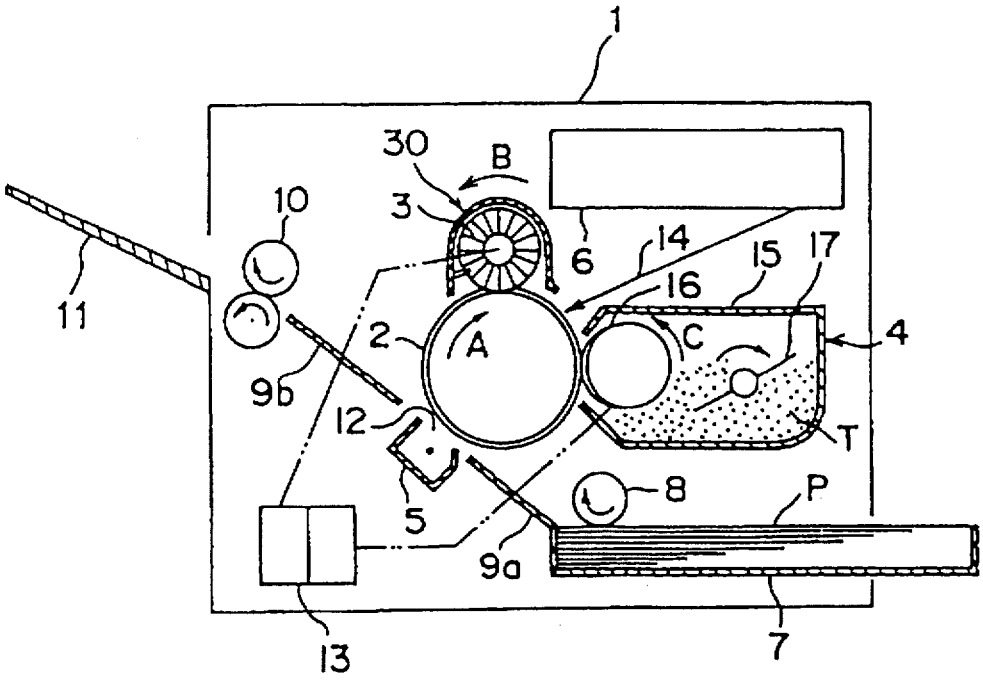
FIG. 1 is a diagrammatic illustration of the construction of an image forming apparatus applying one embodiment of the present invention.
Figure 2:
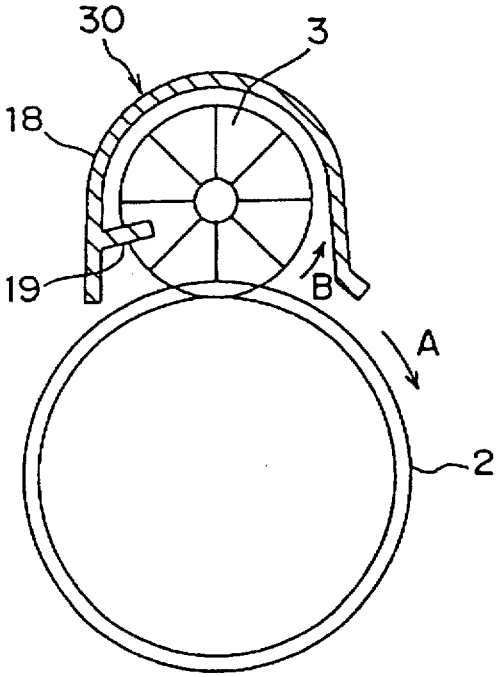
FIG. 2 is an enlargement of the charging device and photoreceptor of the present embodiment.

FIG. 1 shows a construction of the cleanerless image forming apparatus in which the present invention is applied. An image carrier, that is, drum-shaped photoreceptor 2 that has a thin film layer made of an organic photoconductive material formed on its surface, is located in the approximate center of main body 1 of said cleanerless image forming apparatus such that said photoreceptor 2 can rotate in the direction indicated by arrow A. Around photoreceptor 2 are placed, along the direction of its rotation, charging device 30 including charging brush 3, developer cleaning device 4, and transfer charger 5, in that order. Laser device 6 is placed in the upper area inside main body 1 and diagonally above photoreceptor 2.

Paper feeder cassette 7 is located under said developer cleaning device 4, and feeding roller 8 is in contact with paper P housed in this paper feeder cassette 7. A paper path is formed along guides 9*a* and 9*b* such that it passes through transfer area 12, sandwiched by photoreceptor 2 and transfer charger 5, said path extending from said paper feeder cassette 7. When paper P is fed by feeding roller 8, it travels in said paper path and is ejected via pair of fusing rollers 10 onto ejection tray 11 attached to main body 1. Power supply 13 is located in the lower area of main body 1.

Charging brush 3 of charging device 30 is located parallel to the axis of photoreceptor 2 such that it is in contact with photoreceptor 2 with a predetermined amount of indentation overlap (1 mm through 3 mm, for example) in order to obtain stable contact with photoreceptor 2, and it rotates in the state described above in the direction indicated by arrow B at a speed one to five times as fast as that of photoreceptor 2. Charging brush 3 is covered by cover 18 that opens toward photoreceptor 2. Scraping member 19, that protrudes into the interior of this cover 18, is placed parallel to the axis of charging brush 3 such that the scraping member 9 is in contact with charging brush 3 with a predetermined amount of indentation overlap (1 mm through 3 mm, for example) at a position upstream (relative to the rotational direction of the brush or the direction indicated by arrow B) from the contact area between charging brush 3 and photoreceptor 2. It is preferred to form this scraping member 19 as one unit with cover 18 in order to reduce the number of components, as well as to reduce cost, but it may be formed separately and then attached to cover 18, etc.

Charging brush 3 is constructed by planting fibers formed by dispersing conductive particle carbon onto rayon, for example, in a conductive base pipe with a density of from 10,000 to 150,000 fibers per inch. A DC voltage (−1,200v, for example), a switched DC voltage or an alternating current (AC) overlaid on a DC voltage is applied to charging brush 3 when it is connected to power supply 13. This causes charging brush 3 to discharge at its tips, and the surface of photoreceptor 2 becomes approximately uniformly charged with −600v through −900v, for example.

Laser device 6 irradiates laser beam 14 onto the surface of photoreceptor 2 at a position between charging brush 3 and developer cleaning device 4 in accordance with the image information and forms a latent image on the surface of uniformly charged photoreceptor 2, by generating reduced potential areas.

Developer cleaning device 4 has casing 15 that houses non-magnetic monocomponent toner T which becomes charged through friction. This casing 15 opens toward photoreceptor 2, and developing sleeve 16, that can rotate in the direction indicated by arrow C, is placed in this opening such that it faces photoreceptor 2. Developing sleeve 16 is formed using a conductive elastic material, and a developing bias is applied to it when it is connected to power supply 13. As a result, toner T that is held in layers around developing sleeve 16 is carried to the developing area as the sleeve 16 rotates. It then sticks to the latent image on photoreceptor 2 by means of the developing bias, and an image is formed. Inside casing 15 is located stirring wing 17 that rotates in the direction opposite to that of the developing sleeve 16 to prevent coagulation of toner and to provide toner to developing sleeve 16.

Transfer charger 5 applies a voltage having a polarity opposite to the charging polarity of toner to paper P, carried from paper feeder cassette 7 to transfer area 12 in synchronization with the rotation of photoreceptor 2, from the rear side to statically attract toner, and transfers the toner image on the surface of photoreceptor 2 onto paper P.

The operations of charging device 30 and of the image forming apparatus of this embodiment pertaining to the present invention described above, will now be explained assuming the original charging polarity of the toner is negative. Photoreceptor 2 is portrayed two-dimensionally in FIG. 3 (as well as in FIGS. 4 and 10) for the sake of convenience in explanation.

Figure 3:
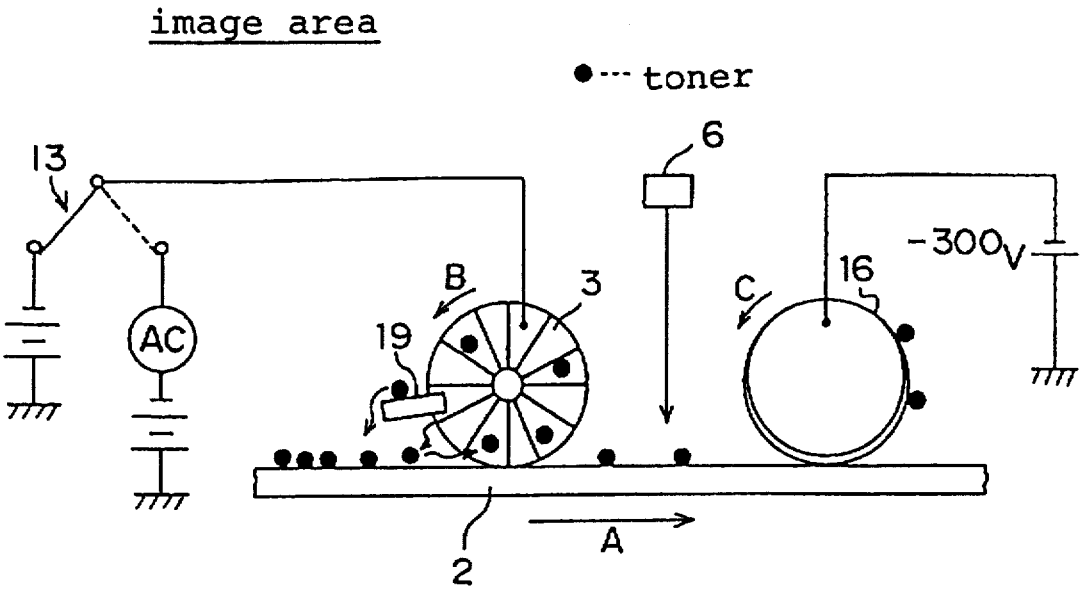
FIG. 3 is a drawing to explain the collection of residual toner in the image area.

First, as shown in FIG. 3, a switched DC voltage obtained by switching the alternating switch on power supply 13 to the position indicated by a solid line, or an alternating current overlaid with a DC voltage obtained by switching said alternating switch to the position indicated by a dotted line (both are voltages having waveforms) is applied to charging brush 3 in the image area, or in other words, in the areas where toner images are formed by developer cleaning device 4. The reason that a voltage having a waveform is applied is that the surface of photoreceptor 2 may be charged more uniformly and unevenness in electrification may be dramatically reduced when compared with the case where a mere DC voltage is applied. Further, as the above operation takes place, a developing bias of −100v to −500v (−300v in this embodiment) is applied to developing sleeve 16.

The toner that was not transferred onto paper P during the previous transfer and remains on photoreceptor 2 includes toner that is charged with the opposite polarity (+) because of the influence of the positive voltage applied to transfer charger 5, as well as the friction between charging brush 3 and the surface of photoreceptor 2, in addition to toner that is charged with the original charging polarity (−). Residual toner that has reached the contact area, between photoreceptor 2 and charging brush 3 as photoreceptor 2 rotates, is broken into indecipherable non-patterns by the tips of the brush 3 that rotates and comes into contact with the surface of photoreceptor 2, and becomes dispersed on photoreceptor 2 to the extent that it no longer hinders succeeding exposures. In addition to the mechanical action described above, charging brush 3 promotes the breaking of the patterns of the residual toner by repelling toner having the same polarity (−), as well as by returning toner charged with the polarity (+) opposite to the original charged polarity (−) to photoreceptor 2 after temporarily attracting it electrostatically and then charging it with the same polarity (−). Furthermore, the positive or negative latent image that slightly remains after transfer is also de-electrified or charged so that any difference in potential is eliminated and the residual electrostatic latent image is virtually erased. This is because a voltage sufficient to cause discharge from photoreceptor 2 is applied to charging brush 3 and the surface of photoreceptor 2 becomes uniformly charged at −600v to −900v through this discharge.

When charging brush 3 breaks the residual toner into non-patterns in the manner described above, toner that is still charged with the opposite polarity (+) due to an insufficiency of charge sticks easily to the brush 3 because it is attracted more than repelled. In addition, some residual toner is scraped by the brush tips and enters the brush 3. As a result, a part of the residual toner is collected from photoreceptor 2 by charging brush 3. On the other hand, however, residual toner that is not collected by charging brush 3, and therefore passes through, is toner that was already charged with the original polarity (−) before it reached charging brush 3 or toner that had the opposite polarity (+) but became charged with the original polarity (−) by means of charging brush 3.

The residual toner collected by charging brush 3 is carried to the area where the brush 3 is in contact with scraping member 19 as the brush 3 rotates. It is then scraped off and removed from the brush by scraping member 19. The toner thus scraped off falls onto photoreceptor 2 upstream (relative to the rotational direction of photoreceptor 2) from the area where the photoreceptor 2 is in contact with charging brush 3, and sticks to photoreceptor 2, after which such toner is carried to the contact area between photoreceptor 2 and charging brush 3 again, together with residual toner which has newly arrived. There some of the residual toner is collected by charging brush 3 in the same manner as that described above and other residual toner passes through. By repeating this process, toner that was initially charged with the opposite polarity (+) and unstable when it arrived at charging brush 3 becomes sufficiently recharged and returns to the original polarity (−) and becomes stable, so that it no longer is collected by and passes through charging brush 3 due to repulsion.

Laser beam 14 is irradiated by laser device 6 onto the surface of photoreceptor 2 on which residual toner that has passed through charging brush 3 is dispersed and which is uniformly charged, in accordance with the image information. The potential of this laser irradiated area (hereinafter 'image area') attenuates relative to non-laser irradiated areas (hereinafter 'non-image area'), thereby newly forming an electrostatic latent image.

When this newly formed electrostatic latent image arrives at the contact area between photoreceptor 2 and developing sleeve 16 as photoreceptor 2 rotates, the toner held around developing sleeve 16 electrostatically adheres to the image area by means of the electric field formed by the bias voltage having the condition described above and developing takes place. At the same time, residual toner that is sufficiently charged with the original polarity (−) and that exists on the non-image area is electrostatically attracted to developing sleeve 16 that has a relatively higher potential compared with the potential of the non-image area, and is collected without failure.

The toner image developed in the manner described above moves to transfer area 12 as photoreceptor 2 rotates. A voltage having a positive polarity is then applied by transfer charger 5, from the rear side of the paper, to paper P carried from paper feeder cassette 7. Through this operation, toner charged with a negative polarity is statically attracted to paper P, whereby the toner image is transferred to paper P from photoreceptor 2. The toner image is fixed onto this paper P onto which the toner image has been transferred by means of pair of fusing rollers 10, after which paper P is ejected onto ejection tray 11.

Figure 4:
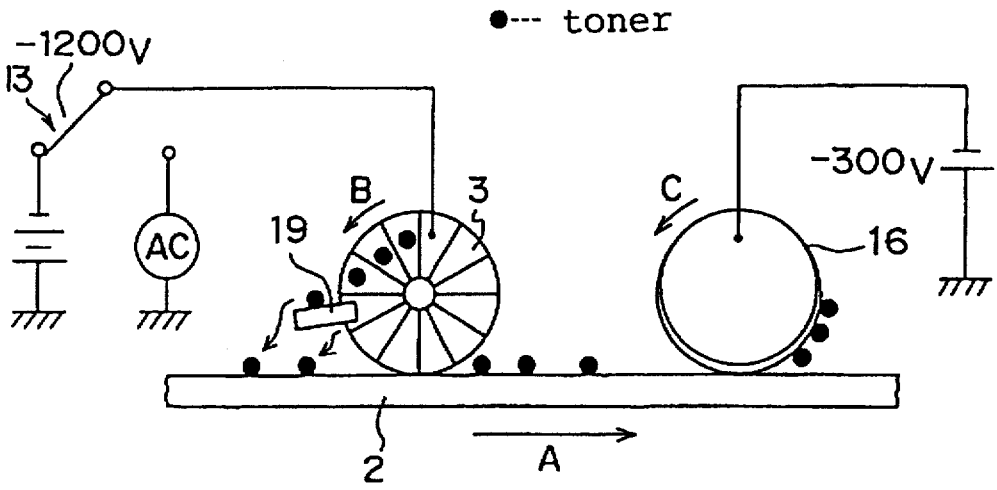
FIG. 4 is a drawing to explain the collection of residual toner in the non-image area.

The cleaning by charging brush 3 in the non-image area, namely, in the areas in front of and behind the image formation area, will now be explained with reference to FIG. 4.

With regard to the non-image area, a voltage that is capable of uniformly charging the surface of photoreceptive member 2 to give said surface a voltage of −600v to −900v, for example a DC voltage of −1200v, is applied to charging brush 3 from power supply 13. On the other hand, −300v bias voltage is applied to developing sleeve 16 as in the case of the image area, but in order to ensure the collection of residual toner by having a large difference in potential relative to the surface of photoreceptor 2, a bias voltage in the range of +50v through +300v may be applied to the non-image area.

The toner remaining on photoreceptor 2 after the previous transfer is carried to the contact area between charging brush 3 and photoreceptor 2 as photoreceptor 2 rotates in the direction indicated by arrow A. At this time, where the voltage applied to charging brush 3 is DC voltage, since a charge can be injected into the residual toner in a stable fashion, the voltage can better charge the residual toner with the original polarity (−) compared with a waveform voltage applied to the image area of charging brush 3. As a result, the static repulsion of charging brush 3 against the residual toner increases, as a result of which the amount of residual toner collected by charging brush 3 markedly decreases while residual toner that becomes charged with a negative polarity and passes through increases. Further, the toner collected by charging brush 3 is scraped off by scraping member 19 without failure, and is sufficiently charged with a negative polarity by charging brush 3, then passes through said brush and is collected by developing sleeve 16. In this way, the cleaning of charging brush 3 can be more effectively performed for the non-image area than for the image area.

Figure 5:
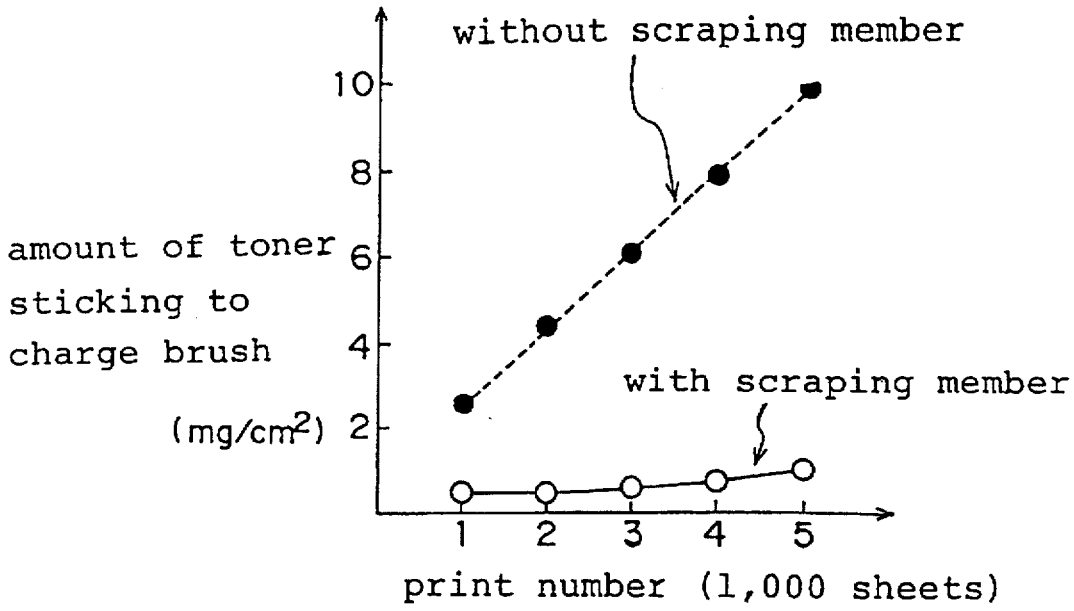
FIG. 5 is a graph comparing a case where a scraping member is used and a case where a scraping member is not used in terms of changes in the amount of toner sticking to the charging brush when a large volume of printing is performed.

FIG. 5 is a graph comparing a case where scraping member 19 is used and a case where it is not used in terms of the amount of toner accumulated on charging brush 3 per unit area of the outer surface of the brush 3. As shown in FIG. 5, where scraping member 19 is not used, the amount of toner sticking increases significantly as the volume of printing increases, whereas where scraping member 19 is used, it increases only slightly.

Figure 6:
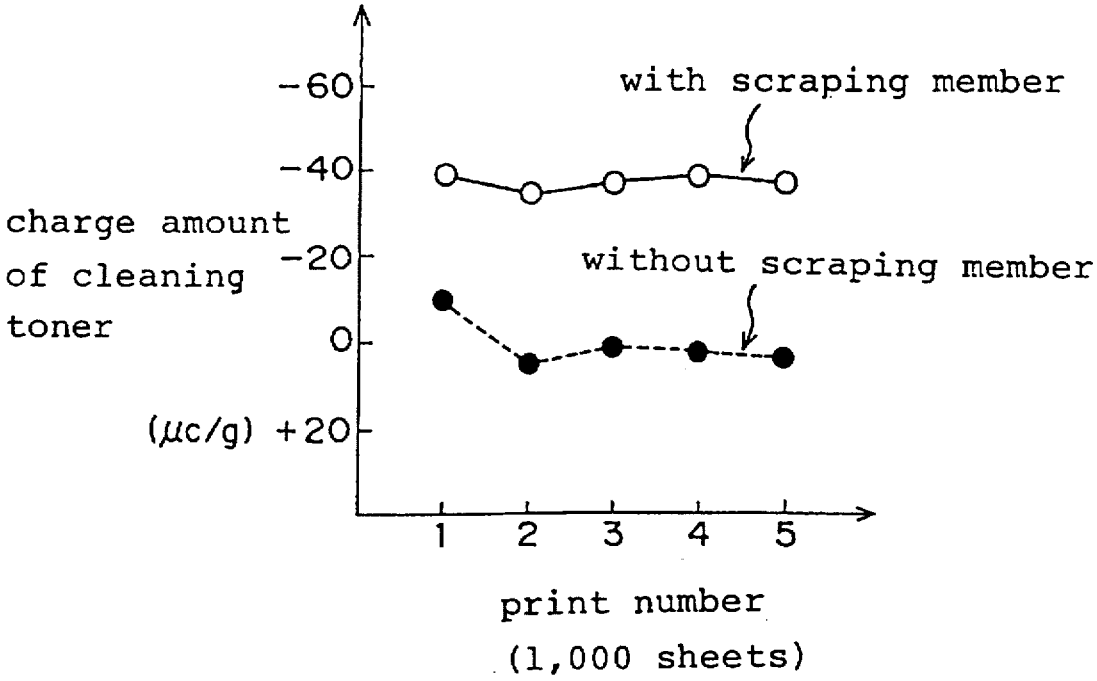
FIG. 6 is a graph comparing a case where a scraping member is used and a case where a scraping member is not used in terms of changes in the amount of charge the toner released from the charging brush receives when a large volume of printing is performed.

FIG. 6 is a graph comparing a case where scraping member 19 is used and a case where it is not used in terms of the amount of charge (μc/g) per unit mass of toner released from charging brush 3 during the cleaning of the non-image area. As shown in FIG. 6, where scraping member 19 is used, the toner charge amount is stable at around −40 μc even if a large volume of printing is performed, which shows the toner also has the original charged polarity as well as sufficient charge amount to be collected by developing sleeve 16.

On the other hand, where scraping member 19 is not used, it can be seen that when the number of printed sheets exceeds 2,000, the toner is not charged at all. This is because as the amount of toner accumulated on charging brush 3 increases, toner particles having different polarities electrostatically attract each other and coagulate inside the brush, or toner particles become attracted and coagulate due to Van der Waals attraction and fusion, which causes toner lumps to stick to the brush, and this prevents the injection of charge into the toner.

When such a situation is present, the toner cannot be released from charging brush 3 or photoreceptor 2 cannot be uniformly charged even if DC voltage is applied. Toner having the opposite polarity and/or insufficiently charged toner then more easily passes through charging brush 3 without being collected, and at the same time, unevenness in the charge of photoreceptor 2 and splashing of toner from the brush occurs, which leads to reductions in image quality such as background fog and sandy appearance of the halftones.

As explained above, by using charging brush 3 of this embodiment equipped with scraping member 19, residual toner collected by the brush can be scraped off without failure, and is prevented from accumulating in charging brush 3. Therefore, even if a large volume of printing is performed, stable images can be obtained without a reduction in image quality.

The configuration, material, etc. of scraping member 19 will now be explained below.

Figure 7:
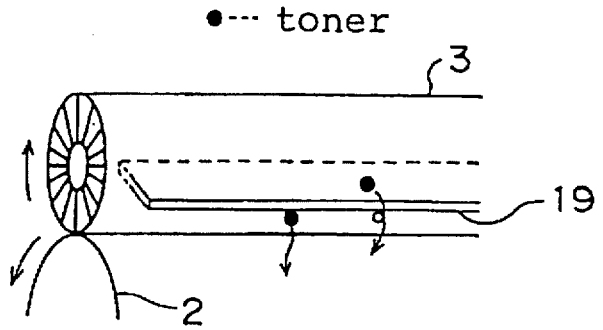
FIGS. 7(*a*), 7(*b*), 7(*c*) and 7(*d*) show examples of modified configurations of the scraping member.
Figure 7:
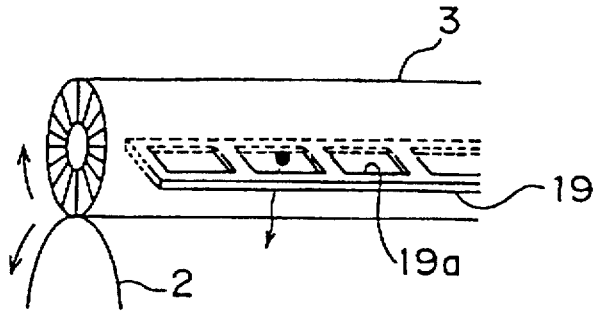
Figure 7:
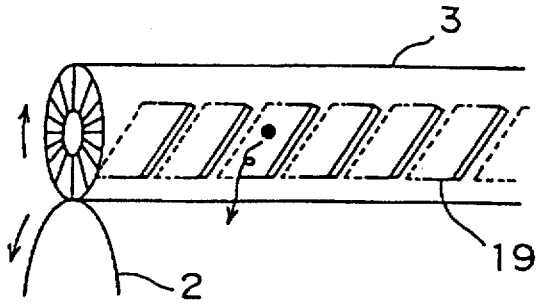
Figure 7:
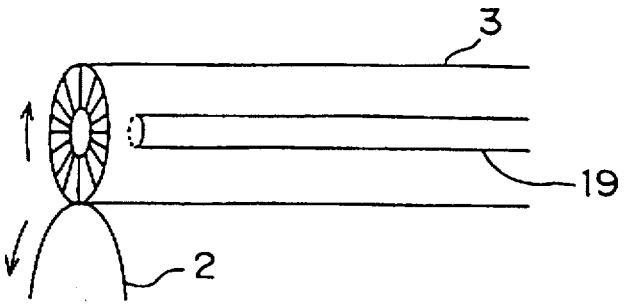

First, scraping member 19 may be configured to be a flat board that is along and thrust into charging brush 3, as shown in FIG. 7(*a*), or a flat board in which hole(s) 19*a* of any given shape are formed (the number of the holes may be just one or more than one) such that the toner scraped off the brush may fall through hole(s) 19*a*, as shown in FIG. 7(*b*). Further, it may be configured to be more than one plate-like members placed in a slanted fashion relative to the axis of charging brush 3 such that the scraped off toner may fall through the gaps between the plate-like members, as shown in FIG. 7(*c*). It may also be configured to be a rod-like member (or a wire) placed along charging brush 3, or a rotatable roller that is coupled driven or actively driven may be placed along charging brush 3, as shown in FIG. 7(*d*).

Figure 8:
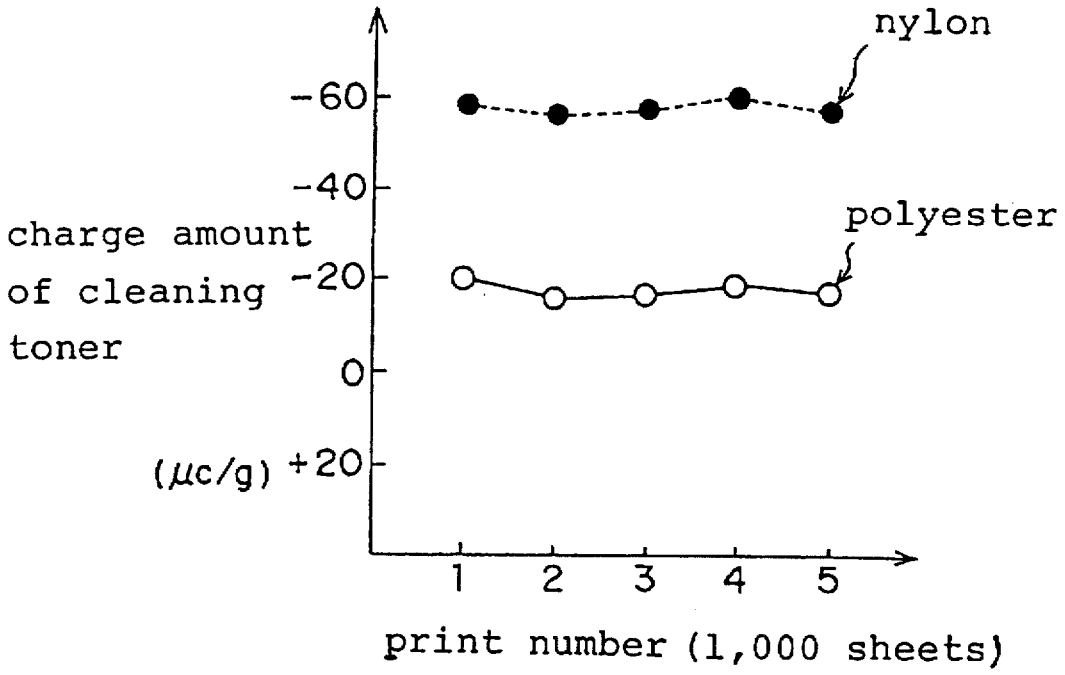
FIG. 8 is a graph comparing a case where the scraping member is formed using a nylon material and a case where the scraping member is made using a polyester material in terms of the amount of charge that the toner that becomes charged receives through the frictional contact with the scraping member.

For the material of scraping member 19, all types of materials, including metals, resins and rubber, may be used. However, it is preferred to choose a material that tends to become charged through frictional electrification with the polarity opposite to the charged polarity of the toner. This is because the charge generated through the friction occurring when charging brush 3 and scraping member 19 come into contact with each other can be injected into the toner being scraped off, thereby the toner is provisionally charged to make it easier to return the toner charged with the opposite polarity to the original polarity. Specifically, where polyester toner is used, as shown in FIG. 8, the provisional charging of the toner may be performed better when a nylon material is used than when a polyester material is used for scraping member 19. In addition, the same effect can be obtained simply by coating the surface of scraping member 19 with a material preferred for the provisional charging of the toner.

Figure 9:
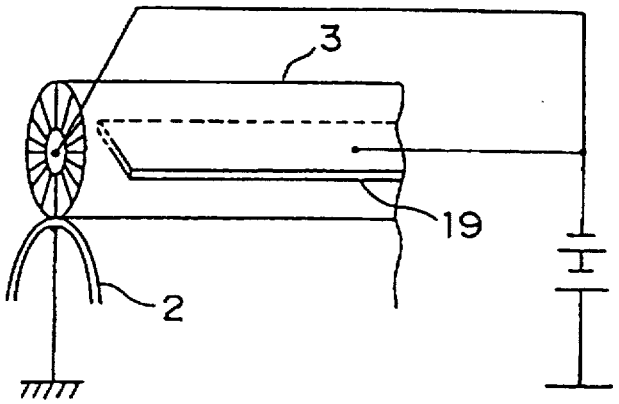
FIG. 9 shows the scraping member to which the same voltage as that applied to the charging brush is applied.

As a method to actively perform the provisional charging of the toner scraped off charging brush 3, scraping member 19 may be formed or coated by a conductive material and a voltage of the same potential as for charging brush 3 may be applied to it, as shown in FIG. 9.

Figure 10:
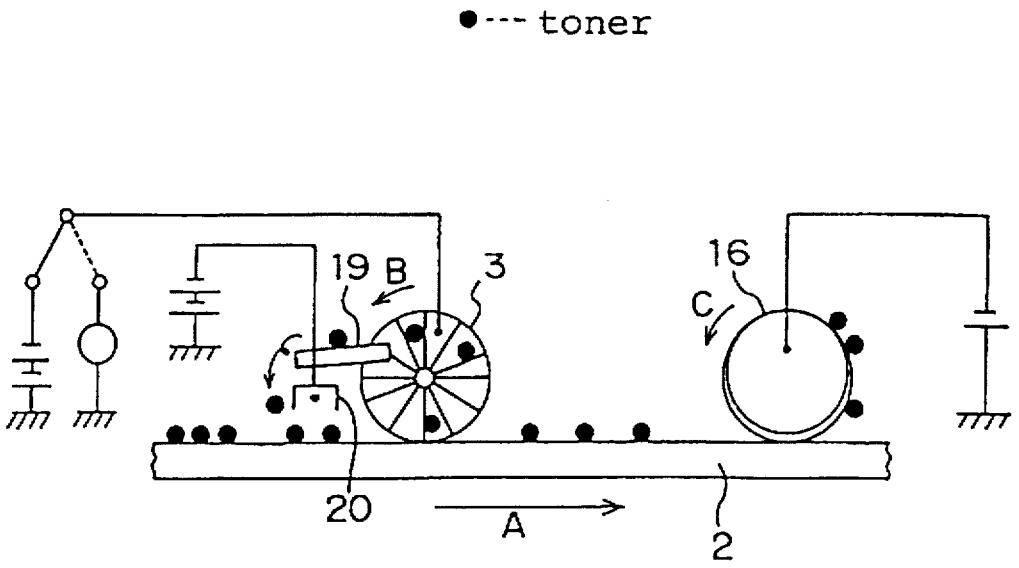
FIG. 10 shows an auxiliary charging member that is located upstream (relative to the rotational direction of the photoreceptor) from the contact area between the photoreceptor and the charging brush.

Alternatively, as shown in FIG. 10, provisional charging member 20 to which a voltage having the same polarity as charging brush 3 is applied may be placed near photoreceptor 2 upstream (direction shown by arrow A) from the contact area between charging brush 3 and photoreceptor 2 relative to the rotational direction of photoreceptor 2. As this provisional charging member 20, a non-contact charging device such as a corona charger, or a contact charging device such as a brush, film and roller may be used.

Using this method, the toner scraped off onto photoreceptor 2 can be effectively charged with the same polarity as the potential of the surface of photoreceptor 2, so that residual toner can be actively collected by developing sleeve 16. Therefore, background fog is prevented more effectively, and good images can be obtained.

In charging device 30 of this embodiment, scraping member 19 is thrust into rotating charging brush 3 to scrape off the toner. As a result, toner dust is generated inside cover 18 that covers charging brush 3.

In order to prevent this dust from escaping cover 18 and contaminating the interior of the mechanism, it is preferred that elastic seal 21 comprising a polyethylene telesterate film, for example, be attached to the edge of cover 18 facing photoreceptor 2 upstream (relative to the rotational direction of photoreceptor 2) or the direction indicated by arrow A from the contact area between charging brush 3 and photoreceptor 2, such that said seal is in contact with the surface of photoreceptor 2 so as to tightly close this area. The elastic seal 21 may be made of an insulating material, but if it is dispersed with conductive particles such as carbon particles and a DC voltage, a switched DC voltage or an alternating current overlaid on a DC voltage, any of said voltages being −1.0v to −1.5v, for example, is applied to said particles, elastic seal 21 functions as provisional charging member 20, and at the same time provides the effect that the potential distribution on the surface of photoreceptor 2 is able to be made more uniform than where the charging is performed by only charging brush 3 to which a waveform voltage is applied.

Figure 12:
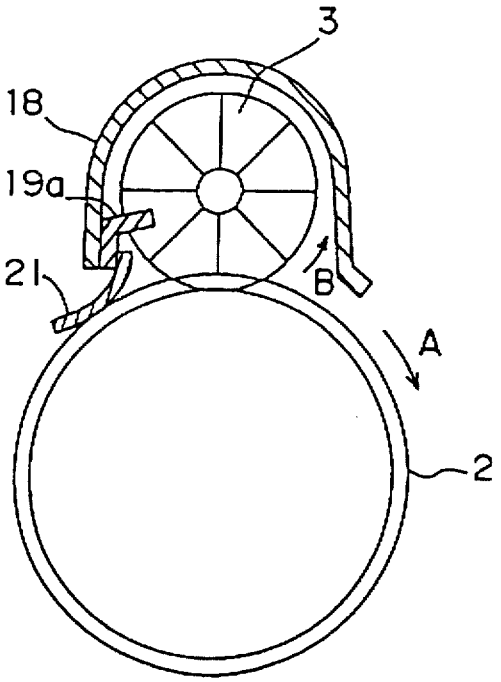
FIG. 12 shows a conductive elastic seal that is electrically connected to the charging brush via a conductive scraping member and that functions as an auxiliary charger.

In addition, where elastic seal 21 is given conductivity such that it can also function as provisional charging member 20, scraping member 19*a* may also be formed as a separate component having conductivity and fixed to cover 18, as shown in FIG. 12, and elastic seal 21 may be attached to this scraping member 19*a*. With such an arrangement, since elastic seal 21 is electrically connected to charging brush 3 through scraping member 19*a*, a connecting member to separately apply a voltage to elastic seal 21 becomes unnecessary, which leads to a reduction in cost due to a reduced number of components and easier assembly.

In recent years, various kinds of sheets are utilized as a transfer material used for copiers or printers, such as a sheet having a special material on its surface or a sheet adhered with glue. As repeating image formation onto these special sheets, the special material or glue provided on the sheets adhere and accumulate onto the photoreceptor, and the adhesive material interrupts charging and exposure, thereby white spots appear in the formed image. Further, in case that a large size material adheres onto the photoreceptor under the condition that the rotational speed of the photoreceptor is faster than that of the developing sleeve, slender oval-shaped white patterns appear in the image. To prevent occurrence of these white patterns, it is preferable to provide pressure member 22 on an upstream side of charging brush 3 with respect to a rotational direction of photoreceptor 2 so as to collect foreign materials such as the above-mentioned adhesive material, paper dust or the like.

This pressure member 22 comprises base plate 23 as well as foam member 24 supported thereby and in pressure contact with the peripheral surface of photoreceptor 2. As a material of foam member 24, polyurethane, polyethylene or rubber is preferable. The size of a foaming cell included in foam member 24 is preferably larger than a diameter of toner and at the same time, smaller than the size of the foreign material, for example, about 10 μm to a few hundred μm. The pressure force of foam member 24 to photoreceptor 2 should be controlled so as not to regulate the movement of residual toner, rub the foreign material onto the surface of photoreceptor 2 or injure the photosensitive layer by the contact of foam member with photoreceptor 2. For example, when foam member has a thickness of 3 mm, it is suitable that the interval between base plate 23 and photoreceptor 2 is about 2 mm, and foam member 24 is in contact with photoreceptor while being compressed about 1 mm. Further, the length of the contacting portion between foam member 24 and photoreceptor 2 (nip portion) with respect to a rotational direction of the photoreceptor is suitably about 5 to 10 mm. And, it is preferable that the upstream portion of foam member 24 with respect to the rotational direction of photoreceptor 2 is separated from photoreceptive member 2 so as to form a wedge-shaped space between photoreceptor 2 and foam member 24, thereby preventing regulation of movement of residual toner.

With the use of such pressure member 22, foreign materials adhered onto photoreceptor 2 are captured by foaming cells of foam member 24 at the contact portion of foam member 24 with photoreceptor 2. However, toner pass through the contact portion of foam member 24 and is transported to the contact portion of charging brush 3. Accordingly, white patterns never appear in an formed image. Further, foreign materials never adhere to charging brush 3, thereby charging efficiency of charging brush 3 is able to be suitably maintained for a long term. Further, by the contact of foam member 24 with photoreceptor 2 during rotation of photoreceptor 2, filming is reduced.

Figure 11:
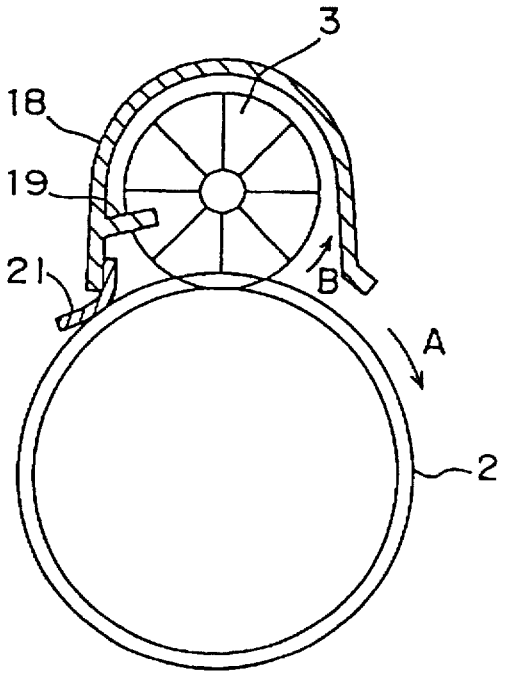
FIG. 11 shows an elastic sheet attached to the cover of the charging brush in order to contain toner dust.
Figure 13:
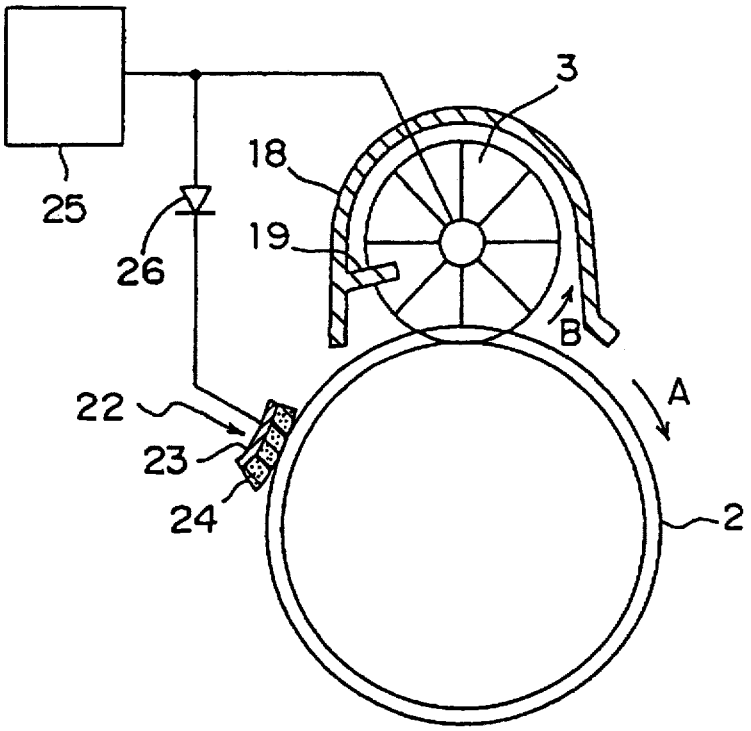
FIG. 13 is an illustration showing an embodiment which provides a foam member on an upstream side of the charging brush.

As shown in FIG. 13, base plate 23 and foam member 24 may be formed by an electroconductive material and not only charge brush 3, but also a voltage can be applied to base plate 23 and foam member 24 by power source 25 via diode 26 so as to provisionally charge photoreceptor 2 at the contact portion of foam member 24. It is suitable that voltage applied to foam member 24 is about −300 V—1300V, and the resistance value of diode 26 in that case is about $10^3$~$10^9$ Ω. Preferably, voltage applied to foam member 24 periodically changes its value, for example, such as pulse current formed by overlaying alternating current to direct current. By the periodical change of the voltage, adhesive force between photoreceptor 2 and the foreign materials is weakened and the efficiency of collecting the foreign materials is improved. Thereby, pressure contact force of foam member 24 to photoreceptor 2 is weakened and the damage of photoreceptor 2 is able to be reduced as much as possible. Further, though not illustrated in FIG. 13, elastic seal 21 may be provided on cover 18 of charging brush 3 as shown in FIGS. 11 and 12.

While a case applying a non-magnetic monocomponent reversal developing method was explained in the above embodiment, the present invention is not limited thereto, and it may also be applied in other public domain methods such as the magnetic monocomponent brush method and dual-component magnetic brush method, as well as in a case where the normal developing method is used. Further, while a case in which the surface of photoreceptor 2 is charged with a negative polarity was explained in this embodiment, the present invention may also be applied in a case where photoreceptor 2 is charged with a positive polarity.

As is clear from the explanation above, using the charging device of the present invention, residual developer collected from the image carrier onto the charging brush can be scraped off without failure using a scraping member such that the residual developer may be prevented from accumulating in the charging brush. Therefore, stable images may be obtained without deterioration in image quality even where a large volume of printing is performed.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A charging device in an image forming apparatus which includes a developing-cleaning device for developing an electrostatic latent image on a surface of an image bearing member and, at the same time, for collecting residual developer remaining on the surface of the image bearing member after a previous transfer, the charging device comprising:

a charging brush in contact with the surface of the image bearing member for charging the surface of the image bearing member; and a scraping member contacting with the charging brush with a predetermined amount of indentation overlap at an upstream side of a contact portion between the charging brush and the image bearing member with respect to a movement direction of the image bearing member, wherein the scraping member is a plate arranged along the charging brush and has at least one hole through which scraped developer can fall.

2. A charging device in an image forming apparatus which includes a developing-cleaning device for developing an electrostatic latent image on a surface of an image bearing member and, at the same time, for collecting residual developer remaining on the surface of the image bearing member after a previous transfer, the charging device comprising:

a charging brush in contact with the surface of the image bearing member for charging the surface of the image bearing member;

a scraping member contacting with the charging brush with a predetermined amount of indentation overlap at an upstream side of a contact portion between the charging brush and the image bearing member with respect to a movement direction of the image bearing member; and provisional charging means on an upstream side of said contact portion with respect to the movement direction of the image bearing member, said provisional charging means charging the surface of the image bearing member with a voltage of the same polarity as that of the charging brush.

3. A charging device in an image forming apparatus which includes a developing-cleaning device for developing an electrostatic latent image on a surface of an image bearing member and, at the same time, for collecting residual developer remaining on the surface of the image bearing member after a previous transfer, the charging device comprising:

a charging brush in contact with the surface of the image bearing member for charging the surface of the image bearing member;

a scraping member contacting with the charging brush with a predetermined amount of indentation overlap at an upstream side of a contact portion between the charging brush and the image bearing member with respect to a movement direction of the image bearing member;

a cover member provided around the charging brush and opened to the image bearing member so as to cover the charging brush, wherein said scraping member is attached to the cover member; and an elastic seal member at an end portion of said cover member on an upstream side of said contact portion with respect to the movement direction of the image bearing member, the elastic seal member being provided in contact with the image bearing member, wherein said elastic seal member is formed of a conductive material and has a wave form voltage applied thereto.

4. The charging device as claimed in claim 3, wherein said scraping member is formed of a conductive material, and wherein said elastic seal member is attached to said scraping member.

5. A charging device in an image forming apparatus which includes a developing-cleaning device for developing an electrostatic latent image on a surface of an image bearing member and, at the same time, for collecting residual developer remaining on the surface of the image bearing member after a previous transfer, the charging device comprising:

a charging brush in contact with the surface of the image bearing member for charging the surface of the image bearing member;

a scraping member contacting with the charging brush with a predetermined amount of indentation overlap at an upstream side of a contact portion between the charging brush and the image bearing member with respect to a movement direction of the image bearing member;

a cover member provided around the charging brush and opened to the image bearing member so as to cover the charging brush, wherein said scraping member is attached to the cover member; and a pressure member in pressure contact with the image bearing member on an upstream side of said contact portion with respect to the movement direction of the image bearing member, so as to collect foreign materials from the image bearing member.

6. The charging device as claimed in claim 5, further comprising a power source for applying a voltage to the charging brush, wherein said power source is connected with the pressure member for applying a voltage to the pressure member for provisionally charging the image bearing member.

7. An image forming apparatus comprising:

an image bearing member having a surface;

a charging brush in contact with the image bearing member for charging the surface of the image bearing member:

a developing-cleaning device for developing an electrostatic latent image formed on the image bearing member and, at the same time, for collecting residual developer remaining on the image bearing member after a previous transfer:

a scraping member contacting with the charging brush with a predetermined amount of indentation overlap on an upstream side of a contact portion between the charging brush and the image bearing member with respect to a movement direction of the image bearing member; and provisional charging means on an upstream side of said contact portion with respect to a movement direction of the image bearing member, said provisional charging means charging the surface of the image bearing member with a voltage of the same polarity as that of the charging brush.

8. An image forming apparatus comprising:

an image bearing member having a surface;

a charging brush in contact with the image bearing member for charging the surface of the image bearing member:

a developing-cleaning device for developing an electrostatic latent image formed on the image bearing member and, at the same time, for collecting residual developer remaining on the image bearing member after a previous transfer;

a scraping member contacting with the charging brush with a predetermined amount of indentation overlap on an upstream side of a contact portion between the charging brush and the image bearing member with respect to a movement direction of the image bearing member; and a pressure member in pressure contact with the image bearing member on an upstream side of said contact portion with respect to the movement direction of the image bearing member, so as to collect foreign materials from the image bearing member.

9. A charging device in an image forming apparatus which includes a developing-cleaning device for developing an electrostatic latent image on an image bearing member and at the same time, for collecting residual developer remaining on the image bearing member after a previous transfer, the charging device comprising:

a charging brush in contact with the image bearing member for charging the surface of the image bearing member; and a scraping member contacting with the charging brush with a predetermined amount of indentation overlap at an upstream side of a contact portion between the charging brush and the image bearing member with respect to a rotational direction of the charging brush;

wherein said scraping member is a plate arranged along the image bearing member; and wherein said scraping member has at least one hole through which scraped developer can fall.

10. A charging device in an image forming apparatus which includes a developing-cleaning device for developing an electrostatic latent image on an image bearing member and at the same time, for collecting residual developer remaining on the image bearing member after a previous transfer, the charging device comprising:

a charging brush in contact with the image bearing member for charging the surface of the image bearing member;

a scraping member contacting with the charging brush with a predetermined amount of indentation overlap at an upstream side of a contact portion between the charging brush and the image bearing member with respect to a rotational direction of the charging brush; and provisional charging means on an upstream side of said contact portion with respect to a rotational direction of the image bearing member, said provisional charging means charging the surface of the image bearing member with a voltage of the same polarity as that of the charging brush.

11. A charging device in an image forming apparatus which includes a developing-cleaning device for developing an electrostatic latent image on an image bearing member and at the same time, for collecting residual developer remaining on the image bearing member after a previous transfer, the charging device comprising:

a charging brush in contact with the image bearing member for charging the surface of the image bearing member;

a scraping member contacting with the charging brush with a predetermined amount of indentation overlap at an upstream side of a contact portion between the charging brush and the image bearing member with respect to a rotational direction of the charging brush;

a cover member provided around the charging brush and opened to the image bearing member so as to cover the charging brush, wherein said scraping member is attached to the cover member;

a elastic seal member at an end portion of said cover member on an upstream side of said contact portion with respect to a rotational direction of the image bearing member, the elastic member being provided in contact with the image bearing member;

wherein said seal member is formed by a conductive material and applied a wave form voltage.

12. A charging device in an image forming apparatus which includes a developing-cleaning device for developing an electrostatic latent image on an image bearing member and at the same time, for collecting residual developer remaining on the image bearing member after a previous transfer, the charging device comprising:

a charging brush in contact with the image bearing member for charging the surface of the image bearing member;

a scraping member contacting with the charging brush with a predetermined amount of indentation overlap at an upstream side of a contact portion between the charging brush and the image bearing member with respect to a rotational direction of the charge brush; and a pressure member in pressure contact with the image bearing member on an upstream side of said contact portion with respect to the rotational direction of the image bearing member, so as to collect foreign materials from the image bearing member.

13. A charging device in an image forming apparatus which includes a developing-cleaning device for developing an electrostatic latent image on an image bearing member and at the same time, for collecting residual developer remaining on the image bearing member after a previous transfer, the charging device comprising:

a charging brush in contact with the image bearing member for charging the surface of the image bearing member;

a scraping member contacting with the charging brush with a predetermined amount of indentation overlap at an upstream side of a contact portion between the charging brush and the image bearing member with respect to a rotational direction of the charge brush; and a power source for applying a voltage to the charging brush, wherein said power source is connected to a pressure member and applies a voltage for provisionally charging the image bearing member.

14. An image forming apparatus comprising: an image bearing member;

a charging brush in contact with the image bearing member for charging the surface of the image bearing member;

a developing-cleaning device for developing an electrostatic latent image formed on an image bearing member and at the same time, for collecting residual developer remaining on the image bearing member after a previous transfer;

a scraping member contacting with the charging brush with a predetermined amount of indentation overlap on an upstream side of a contact portion between the charging brush and the image bearing member with respect to a rotational direction of the charge brush; and provisional charging means on an upstream side of said contact portion with respect to a rotational direction of the image bearing member, said provisional charging means charging the surface of the image bearing member with a voltage of the same polarity as that of the charging brush.

15. An image forming apparatus comprising: an image bearing member;

a charging brush in contact with the image bearing member for charging the surface of the image bearing member;

a developing-cleaning device for developing an electrostatic latent image formed on an image bearing member and at the same time, for collecting residual developer remaining on the image bearing member after a previous transfer;

a scraping member contacting with the charging brush with a predetermined amount of indentation overlap on an upstream side of a contact portion between the charging brush and the image bearing member with respect to a rotational direction of the charge brush; and a pressure member in pressure contact with the image bearing member on an upstream side of said contact portion with respect to the rotational direction of the image bearing member, so as to collect foreign materials from the image bearing member.

16. A method for forming an image, said method comprising the steps of:

moving an image bearing member in a movement direction, said image bearing member having a surface;

rotating a charging brush in contact with the surface of the image bearing member for charging the surface of the image bearing member;

utilizing a developing-cleaning device for developing an electrostatic latent image formed on the image bearing member and, at the same time, for collecting residual developer remaining on the image bearing member after a previous transfer; and positioning a scraping member in contact with the charging brush with a predetermined amount of indentation overlap on an upstream side of a contact portion between the charging brush and the image bearing member with respect to the movement direction of the image bearing member, so that toner, which is scraped from the charging brush by the scraping member, falls onto the surface of the image bearing member upstream of said contact portion with respect to the movement direction of the image bearing member and is then carried to said contact portion.

17. A method in accordance with claim 16, wherein said scraping member is formed of a conductive material, and further comprising the step of applying same voltage to each of said charging brush and said scraping member.

18. A method in accordance with claim 16, further comprising:

applying a voltage of a first polarity to said charging brush; and provisionally charging the surface of the image bearing member upstream of said contact portion with a voltage of the first polarity.

19. A method in accordance with claim 16, further comprising providing holes in said scraping member so that the toner can fall through said holes onto the surface of the image bearing member.

* * * * *

UNITED STATES PATENT AND TRADEMARK OFFICE

CERTIFICATE OF CORRECTION

PATENT NO. : 5,754,926

DATED : May 19, 1998

INVENTOR(S) : SAKURABA et al

It is certified that error appears in the above-identified patent and that said Letters Patent is hereby corrected as shown below:

Column 12, claim 7, line 41, delete "member:" and insert --member;--.

Column 12, claim 7, line 46, delete "transfer:" and insert --transfer;--.

Column 12, claim 8, line 64, delete "member:" and insert --member;--.

Signed and Sealed this

Sixth Day of October, 1998

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,754,926

DATED : May 19, 1998

INVENTOR(S) : SAKURABA et al

It is certified that error appears in the above-identified patent and that said Letters Patent is hereby corrected as shown below:

Column 14, claim 11, line 4, delete "member;" and insert --member; and--.

Column 14, claim 11, line 5, delete "a elastic" and insert --an elastic--.

Column 14, claim 11, line 11, delete "material and applied a wave form voltage." and insert --material and has a wave form voltage applied thereto.--.

Column 16, claim 17, line 19, delete "applying same" and insert --applying a same--.

Signed and Sealed this

Fifth Day of January, 1999

*Attest:*

*Attesting Officer*

*Acting Commissioner of Patents and Trademarks*